US009279322B2

(12) United States Patent
Dirksen

(10) Patent No.: US 9,279,322 B2
(45) Date of Patent: Mar. 8, 2016

(54) SYSTEMS AND METHODS FOR PULSED-FLOW PULSED-ELECTRIC DRILLING

(75) Inventor: Ronald J. Dirksen, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 710 days.

(21) Appl. No.: 13/564,036

(22) Filed: Aug. 1, 2012

(65) Prior Publication Data

US 2013/0032397 A1 Feb. 7, 2013

Related U.S. Application Data

(60) Provisional application No. 61/514,299, filed on Aug. 2, 2011, provisional application No. 61/514,312, filed on Aug. 2, 2011, provisional application No. 61/514,319, filed on Aug. 2, 2011.

(51) Int. Cl.

| | |
|---|---|
| ***E21B 7/15*** | (2006.01) |
| ***E21B 47/18*** | (2012.01) |
| ***E21C 37/18*** | (2006.01) |
| ***E21B 10/18*** | (2006.01) |

(52) U.S. Cl.

CPC ..... *E21B 47/187* (2013.01); *E21B 7/15* (2013.01); *E21B 10/18* (2013.01); *E21C 37/18* (2013.01)

(58) Field of Classification Search

CPC ..... E21B 7/04; E21B 7/146; E21B 7/15; E21B 10/18; E21B 47/187; E21C 37/18; B02C 2019/183

USPC ..... 175/16, 17, 206

See application file for complete search history.

(56) References Cited

U.S. PATENT DOCUMENTS

| | | | | |
|---|---|---|---|---|
| 2,193,219 | A | 3/1940 | Bowie et al. | |
| 3,158,207 | A | 11/1964 | Rowley | |
| 3,447,615 | A | 6/1969 | Schick | |
| 4,390,878 | A | 6/1983 | Harrell | |
| 4,741,405 | A | 5/1988 | Moeny et al. | |
| 5,018,590 | A | 5/1991 | Weldon | |
| 5,771,984 | A * | 6/1998 | Potter et al. | 175/14 |
| 6,206,108 | B1 | 3/2001 | MacDonald et al. | |
| 6,227,316 | B1 * | 5/2001 | Rohde | 175/340 |

(Continued)

FOREIGN PATENT DOCUMENTS

| | | |
|---|---|---|
| EP | 2554780 | 2/2013 |
| EP | 2554781 | 2/2013 |

(Continued)

OTHER PUBLICATIONS

Comeaux, Blaine C., et al., "Systems and Methods for Drilling Boreholes with Noncircular or Variable Cross-Sections", U.S. Appl. No. 13/564,338, filed Aug. 1, 2012, 17 pgs.

(Continued)

*Primary Examiner* — David Andrews
*Assistant Examiner* — Carib Oquendo
(74) *Attorney, Agent, or Firm* — Krueger Iselin LLP; Scott H. Brown

(57) ABSTRACT

A pulsed-electric drilling system includes a bit that extends a borehole by detaching formation material with pulses of electric current from one or more electrodes, and a drillstring that defines at least one path for a fluid flow to the bit to flush detached formation material from the borehole. The system modulates the fluid flow across the one or more electrodes.

17 Claims, 3 Drawing Sheets

(56) References Cited

U.S. PATENT DOCUMENTS

| | | | | |
|---|---|---|---|---|
| 6,791,469 | B1 | 9/2004 | Rao et al. | |
| 7,559,378 | B2 | 7/2009 | Moeny | |
| 7,819,205 | B2 | 10/2010 | Tobben | |
| 8,538,697 | B2 | 9/2013 | Russell et al. | |
| 9,027,669 | B2 | 5/2015 | Dirksen | |
| 2004/0144541 | A1 | 7/2004 | Picha et al. | |
| 2008/0245568 | A1* | 10/2008 | Jeffryes | 175/16 |
| 2009/0050371 | A1* | 2/2009 | Moeny | 175/57 |
| 2009/0133929 | A1* | 5/2009 | Rodland | 175/16 |
| 2012/0165997 | A1 | 6/2012 | Lewis et al. | |
| 2012/0169841 | A1 | 7/2012 | Chemali et al. | |
| 2012/0186816 | A1 | 7/2012 | Dirksen et al. | |
| 2012/0228882 | A1 | 9/2012 | Dirksen et al. | |

FOREIGN PATENT DOCUMENTS

| | | |
|---|---|---|
| EP | 2554782 | 2/2013 |
| WO | WO-2008/002092 | 1/2008 |
| WO | WO-2010/027866 | 3/2010 |

OTHER PUBLICATIONS

Comeaux, Blaine C., et al., "Systems and Methods for Drilling Boreholes with Noncircular or Variable Cross-Sections", U.S. Appl. No. 61/514,333, filed Aug. 2, 2011, 6 pgs.

Dirksen, Ronald J., "Cooled-Fluid Systems and Methods for Pulsed-Electric Drilling", U.S. Appl. No. 61/514,299, filed Aug. 2, 2011, 5 pgs.

Dirksen, Ronald J., "Cooled-fluid Systems and Methods for Pulsed-Electric Drilling", dated Aug. 1, 2012, U.S. Appl. No. 13/564,014, filed Aug. 1, 2012, 19 pgs.

Dirksen, Ronald J., "Pulsed-Electric Drilling Systems and Methods with Reverse Circulation", U.S. Appl. No. 61/514,319, filed Aug. 2, 2011, 6 pgs.

Dirksen, Ronald J., "Pulsed-Electric Drilling Systems and Methods with Reverse Circulation", U.S. Appl. No. 12/692,635, filed Aug. 1, 2012, 19 pgs.

Dirksen, Ronald J., "Systems and Methods for Directional Pulsed-Electric Drilling", U.S. Appl. No. 61/514,304, filed Aug. 2, 2011, 5 pgs.

Dirksen, Ronald J., "Systems and Methods for Directional Pulsed-Electric Drilling", U.S. Appl. No. 13/564,252, filed Aug. 1, 2012, 13 pgs.

Dirksen, Ronald J., "Systems and Methods for Pulsed-Flow Pulsed-Electric Drilling", U.S. Appl. No. 61/514,312, filed Aug. 2, 2011, 5 pgs.

Dirksen, Ronald J., et al., "NMR Tracking of Injected Fluids", PCT Appl No. PCT/US2011/043678, filed Jul. 12, 20121, 18 pgs.

Donderici, Burkay et al., "Pulsed-Electric Drilling Systems and Methods with Formation Evaluation and/or Position Tracking", U.S. Appl. No. 13/564,230, filed Aug. 1, 2012, 23 pgs.

Donderici, Burkay et al., "Pulsed-Electric Drilling Systems and Methods with Formation Evaluation and/or Bit Position Tracking", U.S. Appl. No. 61/514,349, filed Aug. 2, 2011, 6 pgs.

US Non-Final Office Action, dated Jul. 11, 2014, U.S. Appl. No. 13/564,014, "Cooled-fluid Systems and Methods for Pulsed-Electric Drilling," filed Aug. 1, 2012, 12 pgs.

US Non-Final Office Action, dated Oct. 14, 2014, U.S. Appl. No. 13/564,014, "Cooled-fluid Systems and Methods for Pulsed-Electric Drilling," filed Aug. 1, 2012, 10 pgs.

* cited by examiner

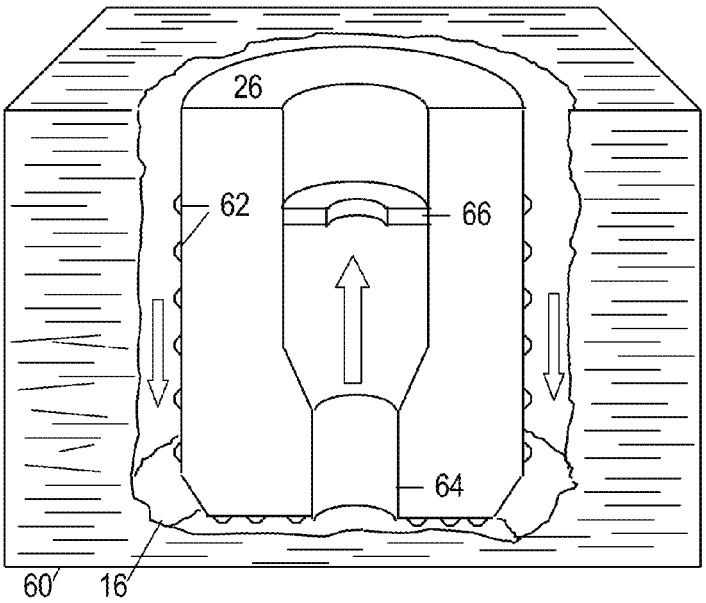
FIG. 3A
FIG. 3B
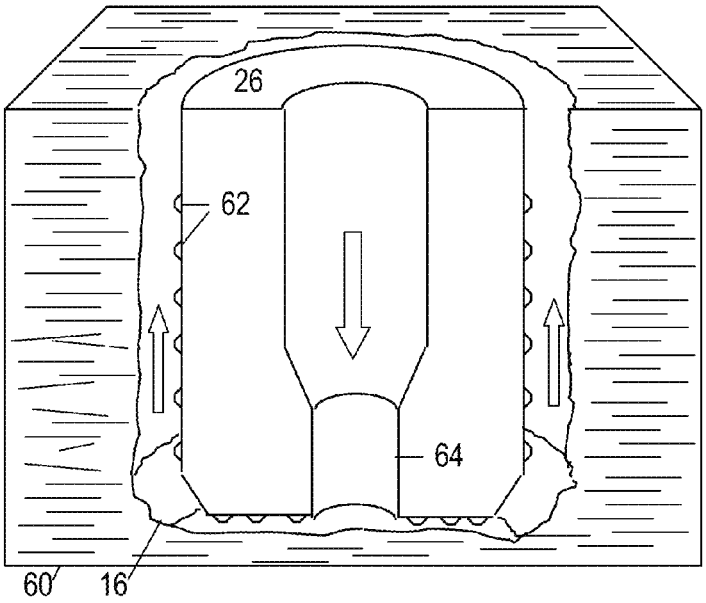

SYSTEMS AND METHODS FOR PULSED-FLOW PULSED-ELECTRIC DRILLING

RELATED APPLICATIONS

The present application claims priority to U.S. Application 61/514,299, titled "Cooled-fluid systems and methods for pulsed electric drilling" and filed Aug. 2, 2011, by Ron Dirksen, U.S. Application 61/514,312, titled "Systems and methods for pulsed-flow pulsed-electric drilling" and filed Aug. 2, 2011, by Ron Dirksen, and U.S. Application 61/514,319, titled "Pulsed-electric drilling systems and methods with reverse circulation" and filed Aug. 2, 2011, by Ron Dirksen. Each of the foregoing references are hereby incorporated herein by reference.

BACKGROUND

There have been recent efforts to develop drilling techniques that do not require physically cutting and scraping material to form the borehole. Particularly relevant to the present disclosure are pulsed electric drilling systems that employ high energy sparks to pulverize the formation material and thereby enable it to be cleared from the path of the drilling assembly. Such systems are at illustratively disclosed in: U.S. Pat. No. 4,741,405, titled "Focused Shock Spark Discharge Drill Using Multiple Electrodes" by Moeny and Small; and WO 2008/003092, titled "Portable and directional electrocrushing bit" by Moeny; and WO 2010/027866, titled "Pulsed electric rock drilling apparatus with non-rotating bit and directional control" by Moeny. Each of these references is hereby incorporated herein by reference.

Generally speaking, the disclosed drilling systems employ a bit having multiple electrodes immersed in a highly resistive drilling fluid in a borehole. The systems generate multiple sparks per second using a specified excitation current profile that causes a transient spark to form and arc through the most conducting portion of the borehole floor. The arc causes that portion of the borehole floor penetrated by the arc to disintegrate or fragment and be swept away by the flow of drilling fluid. As the most conductive portions of the borehole floor are removed, subsequent sparks naturally seek the next most conductive paths. If this most conductive path is created by the residue of the previous disintegration, the subsequent sparks will be shunted through the residue rather than through the formation, negating the intended effect of the drilling process. The known pulsed-electric drilling systems and methods do not appear to adequately address this issue.

BRIEF DESCRIPTION OF THE DRAWINGS

Accordingly, there are disclosed herein in the drawings and detailed description, specific embodiments of pulsed-flow systems and methods drilling boreholes with pulsed-electric drill bits. In the drawings:

FIGS. 3A-3B show detail views of an illustrative drill bit with different circulation.

Figure 1:
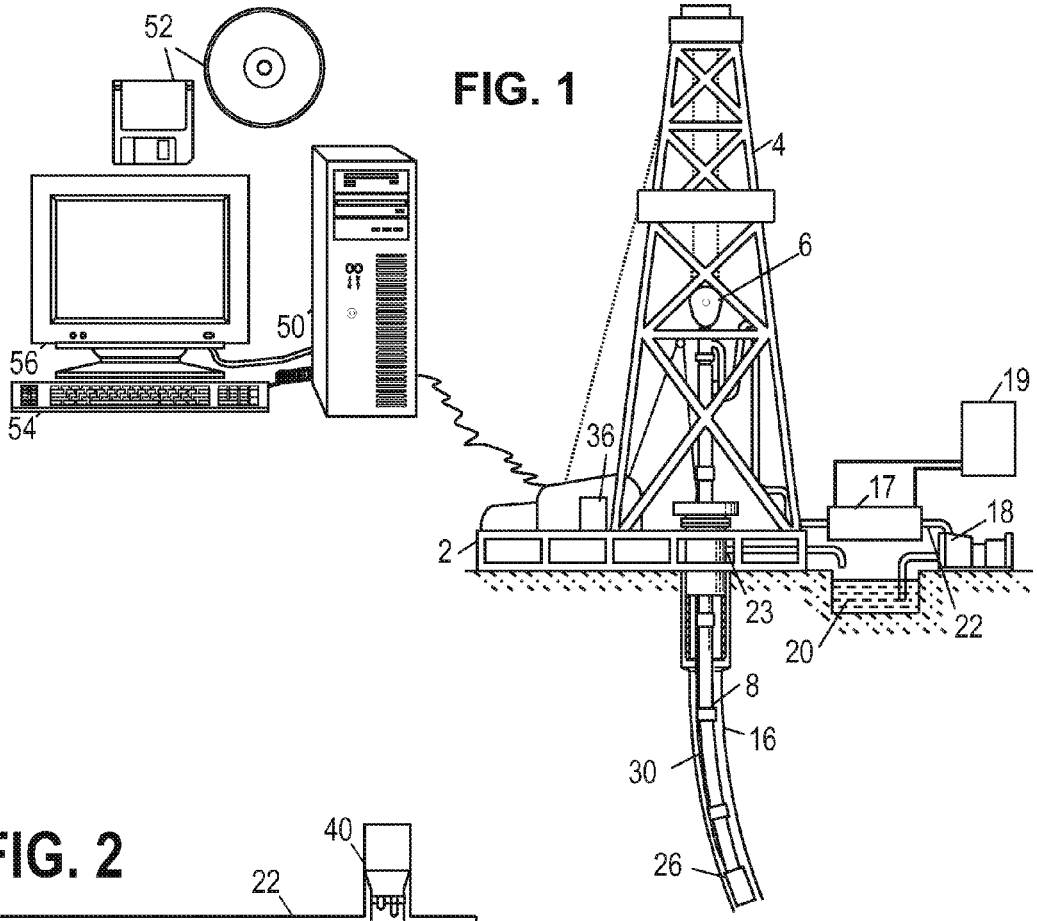
FIG. 1 shows an illustrative pulsed-electric drilling environment.

It should be understood, however, that the specific embodiments given in the drawings and detailed description do not limit the disclosure. On the contrary, they provide the foundation for one of ordinary skill to discern the alternative forms, equivalents, and modifications that are encompassed in the scope of the appended claims.

DETAILED DESCRIPTION

There are disclosed herein a various pulsed-electric drilling systems and methods such as those disclosed by Moeny in the background references, but enhanced with one or more techniques designed to enhance the bit's drilling performance. The techniques highlighted herein include, alone or in combination: reversing the circulation of drilling fluid, cooling the flow of drilling fluid, and pulsing the flow of drilling fluid. As explained herein, these techniques are expected to combat fluid influx and the aftereffects of previous arcs to permit more frequent electric pulses and faster drilling.

For example, it is believed that pre-cooling the drilling fluid flow will improve performance of the bit electronics by eliminating heat build up, but even more significantly, will enhance the drilling rate by reducing gas bubbling. Gas bubbles impair the pulverization process and reduce the debris clearing rate, hence slowing drilling. By reducing such bubbling, the cooled-fluid systems are less impaired and able to maintain high drilling rates for extended time periods.

The cooling systems may be able to operate more efficiently when employed together with reverse circulation, which normally requires lower flow rates than comparably configured forward circulation systems. When reverse circulation is employed with a comparable flow rate to a forward circulation system, the flow pattern causes a convergence of bubbles and debris that may further combat bubbling tendencies and enhance the clearance rate.

Pulsed flow rates can be designed to create "pockets" of drilling fluid uncontaminated by rock debris or inflows of formation fluid. These pockets can be timed so that they are positioned over the electrodes at the firing times for the electric pulses. The isolation of the contaminated fluid from the electrodes minimizes the chance of short circuiting the spark through the fluid rather than penetrating into the formation as desired. Thus the system's drilling rate is maintained even under adverse drilling conditions.

The Pulsed Electric Drilling system as patented by Tetra (see references mentioned in the background) employs a rock destruction device that employs a cluster of power and return electrodes and a conduit for the drilling fluid. The drilling fluid cools the device, transports "drill cuttings" and gas bubbles away from the face of the device and (in case of the "cuttings") up and out of the wellbore to a retention pit. Power to the device is provided by a power generator and power conditioning and delivery systems to convert the power generated into multi kV DC pulsed power required for the system. This is typically done in several steps and high voltage cabling is provided between the different stages of the conditioning system. These circuit will generate heat and should be cooled during their operation to sustain operation for longer periods.

The drilling fluid is non-conductive to prevent the electrical arcs from short-circuiting through the fluid without penetrating into the formation. If the drilling fluid mixes with conductive material (e.g., water inflow from the formation, or pulverized formation debris that is relatively conductive), the firing pulses will flash (short-circuit) between the high voltage and ground electrodes and not destroy rock. It is therefore desired to prevent, or at least control, such mixing as the drilling fluid circulates in and out of the borehole, and that all such contaminants be removed at the surface.

During the rock destruction process "drill cuttings" and gas bubbles are generated, both of which should be rapidly carried away from the face of the electrode containing rock destruction device in order for the device to operate at maximum efficiency. Particularly the gas bubbles will impede system efficiency if not moved away quickly. The drilling fluid provides this flushing. A continuous flow, however, will under some circumstances provide conductive paths that short circuit the electric discharges. It is likely that the system will perform better if the fluid flow is modulated to be in synch with the pulsed power frequency. Based on test results, it will be determined if flowing fluid or stationary fluid at the bit face during a "firing" will deliver best results. Based on such data the drilling fluid can be circulated in a pulsed fashion in sync (either in phase, or out of phase) with the pulsed electric system. Pulsed flow can be achieved by a valve located in the face of the bit which is activated to start oscillating at the same frequency as the pulsed power frequency (~200 Hz) to regulate the flow across the "bitface".

Alternatively, or in conjunction with the use of a pulsed fluid flow, the system may be designed to inhibit or minimize bubble formation through the use of fluid flow cooling and/or reverse circulation. Providing a cooled drilling fluid to the system will 1) improve the efficiency of cooling the power conditioning electronics, which in turn will improve the performance and longevity of the system, and 2) reduce the size of the gas bubbles and expedite the cooling of those gas bubbles such that they will collapse and disappear quickly and not become a problem related to maintaining fluid ECD (effective circulating density) and impeding the drilling process.

When reverse circulation is employed, the fluid flowing to the surface moves through a passage having a smaller cross-section than the annulus. Thus, drilling fluid moving at a given mass or volume flow rate travels with a much higher velocity through the interior passage than through the annulus. Since the efficiency with which fluid clears away debris and bubbles is related to the fluid velocity, reverse circulation systems function with relatively lower mass or volume flow rates than do systems employing normal circulation. Thus, drilling fluid cooling systems for a reverse circulation system can be designed for a lower mass flow rate, which should make it inexpensive. In other words, by using reverse circulation of the drilling fluid the rate of fluid circulation can be reduced which: 1) reduces the size and capacity of the pumps needed for circulation, 2) reduces the volume of fluid to be cooled and treated (water and solids removal)—reducing the size and capacity needs for such systems as well as achieving higher efficiency of the processes, and 3) improves hole cleaning—drill cuttings are much less likely to stay in the borehole. Moreover, the convergence from a flow path with a larger cross-section to a flow path with a smaller cross-section occurs at the bit, offering a opportunity for a flow pattern design that suppresses bubbles.

A variation of the reverse circulation system design employs a dual-passage drillstring such as that manufactured and sold by Reelwell. Such drillstrings provide flow passages for both downhole and return fluid flow, thereby gaining the benefits of reverse circulation systems. The Reelwell system may further provide additional benefits such as extending the reach of the drilling system, which might otherwise be limited due to the non-rotation of the drillstring in the borehole.

In at least some embodiments, the pulsed-electric drilling system circulates the drilling fluid through a cooling system just prior to the fluid entering the borehole. Such a cooling device may be in the form of a tube, or volume cooled by an external refrigeration source, or a radiator type where cold air is blown through the radiator as the fluid moves through it, or any other type suitable to cool large volumes of fluid quickly.

The disclosed system and method embodiments are best understood in an illustrative context. Accordingly, FIG. 1 shows a drilling platform 2 supporting a derrick 4 having a traveling block 6 for raising and lowering a drill string 8. A drill bit 26 is powered via an armored cable 30 to extend borehole 16.

In a reverse circulation system, recirculation equipment 18 pumps drilling fluid from a retention pit 20 through a feed pipe 22 into the annulus around the drillstring where it flows downhole to the bit 26, through ports in the bit into the drillstring 8, and back to the surface through a blowout preventer and along a return pipe 23 into the pit 20. (In an alternative configuration, a crossover sub is positioned near the bit to direct the fluid flowing downhole through the annulus into an internal flow passage of the drill bit, from which it exits through ports and flows up the annulus to the crossover sub where it is directed to the internal flow passage of the drillstring to travel to the surface.) Forward circulation systems pump the drilling fluid through an internal path in the drillstring to the bit 26, where it exits through ports and returns to the surface via an annular space around the drillstring.

The drilling fluid transports cuttings from the borehole into the pit 20 and aids in maintaining the borehole integrity. An electronics interface 36 provides communication between a surface control and monitoring system 50 and the electronics for driving bit 26. A user can interact with the control and monitoring system via a user interface having an input device 54 and an output device 56. Software on computer readable storage media 52 configures the operation of the control and monitoring system.

The feed pipe 22 is equipped with a heat exchanger 17 to remove heat from the drilling fluid, thereby cooling it before it enters the well. A refrigeration unit 19 may be coupled to the heat exchanger 17 to facilitate the heat transfer. As an alternative to the two-stage refrigeration system shown here, the feed pipe 22 may be equipped with air-cooled radiator fins or some other mechanism for transferring heat to the surrounding air. It is expected, however, that a vaporization system would be preferred for its ability to provide greater thermal transfer rates even when the ambient air temperature is elevated.

Figure 2:
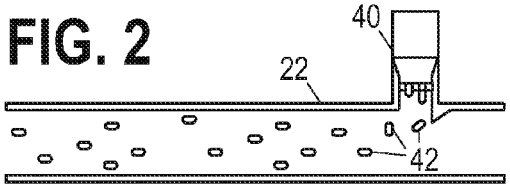
FIG. 2 shows an alternative drilling-fluid cooling system.

Another alternative cooling system is illustrated in FIG. 2, where an injector 40 adds a stream of cold liquid or pellets 42 to the fluid flow in feed pipe 22. The liquid or pellets may consist of a phase-change material such as, e.g., liquid nitrogen or dry ice. The injected material absorbs heat from the fluid flow as the temperature equalizes and/or the material undergoes a phase change, i.e., solid to liquid, solid to gas, or liquid to gas. If necessary, any resulting bubbles may be purged from the flow before it enters the borehole.

FIG. 3A shows a cross-sectional view of an illustrative formation 60 being penetrated by drill bit 26. Electrodes 62 on the face of the bit provide electric discharges to form the borehole 16. An optionally-cooled high-permittivity fluid drilling fluid flows down along the annular space to pass around the electrodes, enter one or more ports 64 in the bit, and return to the surface along the interior passage of the drillstring. The fluid serves to communicate the discharges to the formation and to cool the bit and clear away the debris.

When the fluid has been cooled, it is subject to less bubble generation so that the discharge communication is preserved and the debris is still cleared away efficiently. Moreover, the heat generated by the electronics is drawn away by the cooled fluid, enabling the bit to continue its sustained operation without requiring periodic cool-downs.

FIG. 3A shows an optional constriction 66 that creates a pressure differential to induce gas expansion. While bubbles are undesirable near the electrodes, they may in some cases be beneficially induced or enlarged downstream of the drilling process to absorb heat and further cool the environment near the bit. The constriction may also increase pressure near the bit and inhibit bubbles in that fashion.

FIG. 3B shows the cross-sectional view of the bit with the opposite circulation direction. This circulation direction is typically associated with forward circulation, though as mentioned previously, a crossover sub may be employed uphole from the bit to achieve this bit flow pattern with reverse circulation in the drillstring.

Figure 4:
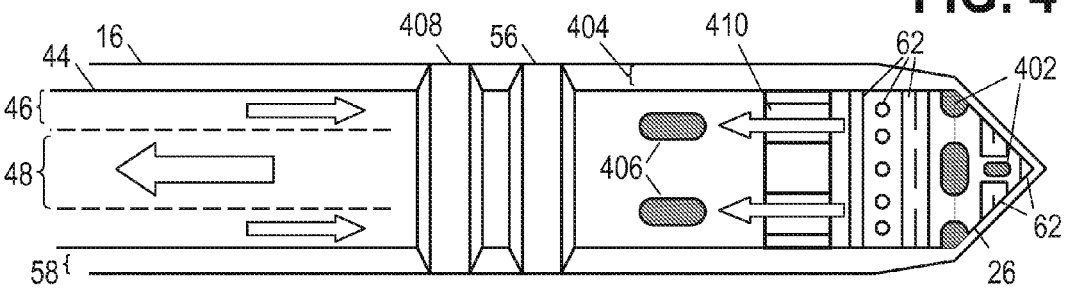
FIG. 4 shows an alternative bottomhole assembly configuration.

FIG. 4 shows an illustrative pulsed-electric drilling system employing a dual-passage drillstring 44 such as that available from Reelwell. The dual-passage drillstring 44 has an annular passage 46 around a central passage 48, enabling the drillstring to transport two fluid flows in opposite directions. In the figure, a downflow travels along annular passage 46 to the bit 26, where it exits through ports 402 to flush away debris. The flow transports the debris along the annular space 404 around the bit to ports 406, where the flow transitions to the central passage 48 and travels via that passage to the surface.

FIG. 4 further shows two rims 408 around the drillstring 44 to substantially enclose or seal the annular space 404. The rim(s) at least partially isolate the drilling fluid in the annular space 404 around the bit from the borehole fluid in the annular space 58 around the drillstring. This configuration is known to enable the use of different fluids for drilling and maintaining borehole integrity, and may further assist in maintaining the bit in contact with the bottom of the borehole when a dense borehole fluid is employed. Moreover, the rim(s) 408 can be employed to reflect acoustic energy, enabling the creation of standing waves in the annular space 404. Bit 26 is shown equipped with a piezoelectric transducer 410 for this purpose, but it may be possible to create such waves using only the electric pulses. Such waves can be employed with or without pulsed fluid flow to create areas of increased pressure and density over the bit electrodes during electric pulses.

Figure 5A:
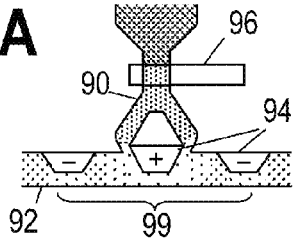
FIGS. 5A-5C show an illustrative mechanism for pulsed fluid flow.
Figure 5B:
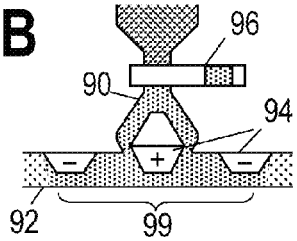
Figure 5C:
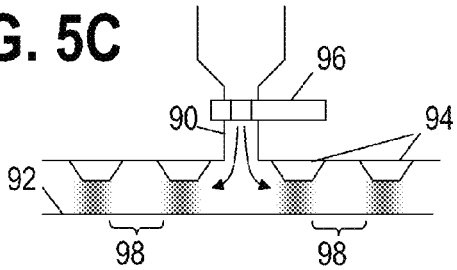

FIGS. 5A-5C show illustrative bit ports 90 that enables fluid to flow in a pulsed fashion from the interior of the bit into the space between the bit and the formation 92 to clear debris and bubbles from the electrodes 94. A valve or rotating disk 96 modulates the flow of the fluid to clear away the debris and any potentially conductive material between electric discharges. Comparing FIGS. 5A-5B, in the former, the valve or disk 96 is open, enabling fluid to jet into region 99 to clear away debris from in front of electrodes 94. As indicated by the shading density, however, the rapid fluid flow in that region may produce a low pressure area due to the Venturi effect. The low pressure area may augment, rather than inhibit, bubble formation, and may further enable an influx of conductive formation fluid, either of which tends to impair drilling efficiency.

Figure 6A:
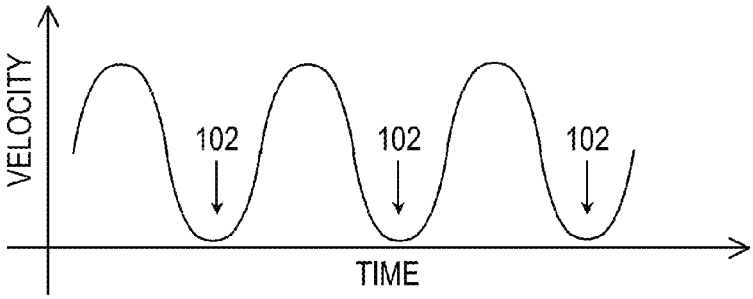
FIGS. 6A-6B are graphs of an oscillatory fluid flow characteristic.
Figure 6B:
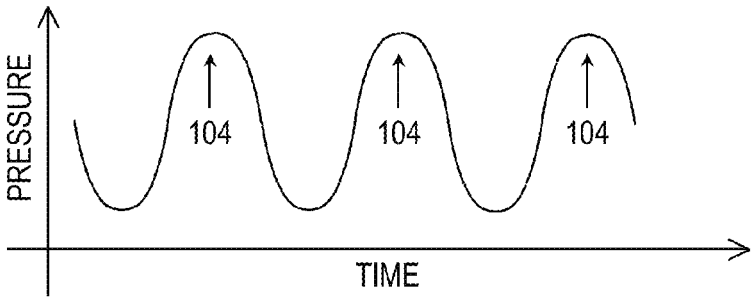

In FIG. 5B, the valve 96 is closed, halting or slowing the fluid flow and creating a high pressure pocket of uncontaminated drilling fluid in front of electrodes 94. The firing of an electric pulse may be timed to occur at this stage, when bubble formation is more inhibited. This timing is illustrated in FIGS. 6A and 6B. FIG. 6A shows the modulation of fluid flow velocity that may be expected in front of the electrodes 94 due to the oscillation of valve or disk 96. (Due to inertial effects, the velocity variation may be offset in phase relative to the operation of the valve.) At times indicated by arrows 102, the flow velocity is minimized and the electric pulses may be fired. While it is believed that this timing is theoretically optimum, experiments may show that secondary effects from fluid inflow and/or debris would cause the optimum timing (as indicated by best achievable rate of penetration) to be shifted in phase relative to this minimum.

Similarly, FIG. 6B shows the modulation of fluid pressure in region 99 due to operation of the valve or disk 96. Again, due to dynamic effects, the phase of the pressure modulation may be offset from the operation of the valve. At the times indicated by arrows 104, the fluid pressure is maximized and the electric pulses may be fired. Experiments may indicate that the optimum timing is offset in phase from this maximum.

If it is not possible to entirely flush the region 99 in front of the electrodes between firings, the modulation may instead be designed to at least create pockets of uncontaminated fluid 98 between any pockets of potentially conductive material as shown in FIG. 5C. (Note that in contrast to FIGS. 5A-5B, the shading in FIG. 5C is used to indicate areas of potential contamination of the drilling fluid.) Where possible such pockets may be positioned in front of the electrodes during the firing phase, but in any event such pockets may serve as insulating barriers 98 between potentially conductive material to prevent flashing between the power and ground electrodes.

Figure 7:
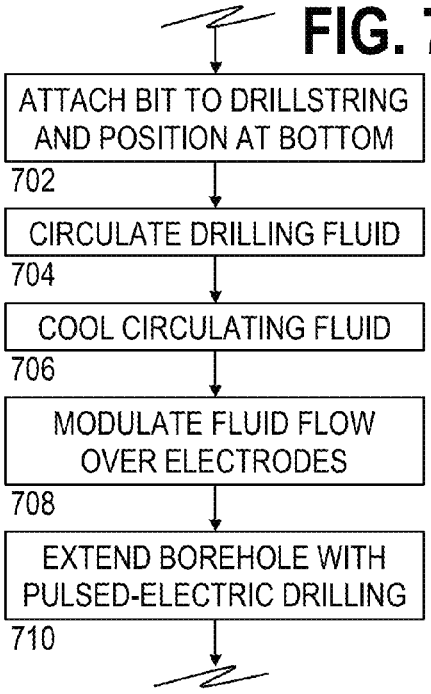
FIG. 7 is a flowchart of an illustrative pulsed-electric drilling method.

FIG. 7 is a flowchart of operations that may be employed in an illustrative pulsed-electric drilling method. While shown and discussed sequentially, the operations represented by the flowchart blocks will normally be performed in a concurrent fashion. In block 702, a driller assembles a bottomhole assembly with a pulsed-electric bit and runs it into a borehole on a drillstring, placing the bit in contact with the bottom of the hole. As needed, the driller lowers the drillstring to maintain the bit in contact with the bottom and lengthens the drillstring as needed with additional tubing lengths.

In block 704, the system circulates the drilling fluid. As previously mentioned, the drilling fluid is preferably a high-resistivity fluid for communicating electric pulses into the formation ahead of the bit and flushing the debris out of the borehole. In some embodiments, the drilling fluid is circulated in a "forward" circulation, i.e., passing through the central passage of the drillstring to the bit and returning along the annulus around the drillstring. In other embodiments, the drilling fluid is circulated in a reverse circulation, i.e., passing through the central passage of the drillstring from the bit to the surface and reaching the bit by some other means, e.g., through the annulus or through an annular passage in a dual-passage drillstring. In still other embodiments, a crossover sub enables the flow in the region of the bit to be switched from forward to reverse or vice versa.

In block 706, the system optionally cools the drilling fluid, preferably before it enters the borehole. Some embodiments also or alternatively employ gas-expansion cooling near the bit by passing the flow through a pressure-differential. At the surface, the system may employ a heat exchanger, a refrigeration unit, or the addition of phase-change material to the fluid flow.

In block 708, the system optionally modulates the fluid flow over the bit electrodes. The modulation can be done by pulsing a valve or turning a disk with one or more apertures across the flow channel. Other forms of modulation can be employed, including the generation of acoustic waves which in some configurations can be standing waves. Where such modulation is employed, it is preferably synchronous with the firing of the electric pulses to maximize the rate of penetration.

In block 710, the system generates electrical pulses to pulverize formation material ahead of the bit, thereby extending the borehole. The system preferably employs at least one of the disclosed techniques (reverse circulation, cooled drilling fluid, pulsed fluid flow) to enhance the pulsed-electric drilling process by suppressing bubble formation and/or expediting the flushing of bubbles and debris from the electrode region.

These and other variations, modifications, and equivalents will be apparent to one of ordinary skill upon reviewing this disclosure. For example, while it is preferred for flow modulation to occur as the flow passes from a bit port into the borehole, it is recognized that modulation of the flow across the electrodes can also be achieved by modulating the flow as it passes from the borehole into a port in the bit or in a crossover sub. It is intended that the following claims be interpreted to embrace all such variations and modifications where applicable.

What is claimed is:

1. A pulsed-electric drilling system that comprises:

a bit that extends a borehole by detaching formation material with pulses of electric current from one or more electrodes; and a drillstring that defines at least one path for a fluid flow to the bit to flush detached formation material from the borehole, wherein the bit comprises an oscillating valve that oscillates at the same frequency as the pulses causing the fluid flow across the one or more electrodes to be synchronous with the pulses.

2. The pulsed-electric drilling system of claim 1, wherein the bit also employs at least one nozzle with a variable orifice to vary said fluid flow.

3. The pulsed-electric drilling system of claim 1, wherein the drillstring includes a rim to substantially isolate an annular portion of the borehole around the bit.

4. The pulsed-electric drilling system of claim 3, wherein the bit uses a piezoelectric element to induce an acoustic resonance in the isolated portion of the borehole.

5. The pulsed-electric drilling system of claim 4, wherein the bit uses the pulses of electric current to induce said resonance.

6. The pulsed-electric drilling system of claim 1, wherein the bit creates a standing wave over the one or more electrodes.

7. The pulsed-electric drilling system of claim 1, wherein the fluid flow exhibits local pressure oscillations over the one or more electrodes, and wherein the bit causes the pulses of electric current to occur when the local pressure is elevated.

8. The pulsed-electric drilling system of claim 1, wherein the fluid flow exhibits local velocity oscillations over the one or more electrodes, and wherein the bit causes the pulses of electric current to occur when the local velocity is reduced.

9. A pulsed-electric drilling method that comprises:

extending a borehole with a bit that detaches formation material using pulses of electric current from one or more electrodes;

flushing detached formation material from the borehole with a fluid flow; and oscillating the fluid flow across the one or more electrodes to be synchronous with the pulses using an oscillating valve in the bit that oscillates at the same frequency as the pulses.

10. The pulsed-electric drilling method of claim 9, wherein the bit also oscillates the fluid flow using a nozzle with a variable orifice.

11. The pulsed-electric drilling method of claim 9, further comprising: substantially enclosing an annular region of the borehole around the bit.

12. The pulsed-electric drilling method of claim 11, further comprising: inducing an acoustic resonance in said annular region.

13. The pulsed-electric drilling method of claim 12, wherein the acoustic resonance is induced by the pulses of electric current.

14. The pulsed-electric drilling method of claim 12, wherein the acoustic resonance is induced with a piezoelectric element.

15. The pulsed-electric drilling method of claim 9, wherein said oscillating creates a standing wave over the one or more electrodes.

16. The pulsed-electric drilling method of claim 9, wherein said oscillating causes a periodic elevation of local pressure over the one or more electrodes, and wherein said extending includes pulsing the electric current when the local pressure is elevated.

17. The pulsed-electric drilling method of claim 9, wherein said oscillating causes a periodic reduction in local velocity over the one or more electrodes, and wherein said extending includes pulsing the electric current when the local velocity is reduced.

* * * * *